US010465268B2

(12) United States Patent
Bergman

(10) Patent No.: US 10,465,268 B2
(45) Date of Patent: Nov. 5, 2019

(54) PRE-ALLOYED IRON-BASED POWDER, AN IRON-BASED POWDER MIXTURE CONTAINING THE PRE-ALLOYED IRON-BASED POWDER AND A METHOD FOR MAKING PRESSED AND SINTERED COMPONENTS FROM THE IRON-BASED POWDER MIXTURE

(71) Applicant: HÖGANÄS AB (PUBL), Höganäs (SE)

(72) Inventor: Ola Bergman, Helsingborg (SE)

(73) Assignee: HÖGANÄS AB (PUBL), Höganäs (SE)

( * ) Notice: Subject to any disclaimer, the term of this patent is extended or adjusted under 35 U.S.C. 154(b) by 236 days.

(21) Appl. No.: 15/510,883

(22) PCT Filed: Sep. 15, 2015

(86) PCT No.: PCT/EP2015/071115
§ 371 (c)(1),
(2) Date: Mar. 13, 2017

(87) PCT Pub. No.: WO2016/041977
PCT Pub. Date: Mar. 24, 2016

(65) Prior Publication Data

US 2017/0275740 A1 Sep. 28, 2017

(30) Foreign Application Priority Data

Sep. 16, 2014 (EP) ..... 14184863

(51) Int. Cl.
*C22C 38/02* (2006.01)
*C22C 38/18* (2006.01)
(Continued)

(52) U.S. Cl.
CPC ..... *C22C 33/0228* (2013.01); *B22F 5/08* (2013.01); *C22C 33/0264* (2013.01);
(Continued)

(58) Field of Classification Search
CPC ..... C22C 33/0207; C22C 33/0228; C22C 33/0264; C22C 38/02; C22C 38/04;
(Continued)

(56) References Cited

U.S. PATENT DOCUMENTS 4,266,974 A 5/1981 Nitta et al.
5,666,634 A 9/1997 Unami et al.
(Continued)

FOREIGN PATENT DOCUMENTS

EP 0 653 262 A1 5/1995
JP 59173201 A 10/1984
(Continued)

OTHER PUBLICATIONS

International Search Report (PCT/ISA/210) dated Dec. 17, 2015, by the European Patent Office as the International Searching Authority for International Application No. PCT/EP2015/071115.
(Continued)

*Primary Examiner* — Patricia L. Hailey
(74) *Attorney, Agent, or Firm* — Buchanan Ingersoll & Rooney P.C.

(57) ABSTRACT

The present invention provides a low cost pre-alloyed iron based powder which has high compressibility, capable of rendering a compacted and sintered component high green density, (GD), and high sintered density, (SD). Also, a method or process for producing components, especially gears, including compaction of powder mixture containing the pre-alloyed iron-based powder, sintering of the compacted component, Low Pressure carburizing, (LPC), High Pressure Gas Quenching, (HPGQ), and tempering, is provided. In one embodiment, the process includes high temperature sintering. Other aspects of the present invention include a powder mixture containing the pre-alloyed iron based powder and components produced by the new process
(Continued)

Ultimate tensile strength (UTS) versus carbon content for the investigated materials in Example 1.

from the powder mixture. Such carburized components exhibit a hard surface combined with a softer and tougher core, necessary properties for e.g. automotive gears subjected to harsh environment.

19 Claims, 6 Drawing Sheets

(51) Int. Cl.

| | |
|---|---|
| ***C22C 33/02*** | (2006.01) |
| ***B22F 5/08*** | (2006.01) |
| ***C22C 38/04*** | (2006.01) |
| ***C22C 38/12*** | (2006.01) |
| ***C22C 38/22*** | (2006.01) |
| *B22F 3/24* | (2006.01) |

(52) U.S. Cl.
CPC ..... *C22C 38/04* (2013.01); *C22C 38/12* (2013.01); *C22C 38/22* (2013.01); *B22F 2003/241* (2013.01); *B22F 2003/248* (2013.01); *B22F 2998/10* (2013.01); *B22F 2999/00* (2013.01)

(58) Field of Classification Search
CPC ..... C22C 38/12; C22C 38/18; C22C 38/22; B22F 5/08; B22F 2003/241; B22F 2003/248; B22F 2998/10; B22F 2999/00
USPC ..... 420/8, 105, 123, 128; 75/246; 148/206, 148/233, 237
See application file for complete search history.

(56) References Cited

U.S. PATENT DOCUMENTS 6,027,544 A * 2/2000 Arvidsson ..... B22F 1/0088 148/508
6,261,514 B1 * 7/2001 Lindberg ..... C22C 33/02 419/11
6,348,080 B1 2/2002 Arvidsson et al.
7,341,689 B2 * 3/2008 Engstrom ..... C22C 33/0264 419/11
8,398,739 B2 * 3/2013 Bengtsson ..... C22C 33/0207 75/231
2002/0048526 A1 * 4/2002 Nakamura ..... B22F 3/1007 419/14
2002/0048626 A1 * 4/2002 Miller ..... A23G 9/045 426/590
2005/0039576 A1 * 2/2005 Unami ..... C22C 33/0207 75/246
2007/0048169 A1 * 3/2007 Sun ..... C22C 33/0264 419/28
2008/0202651 A1 * 8/2008 Uenosono ..... B22F 3/16 148/579
2010/0196188 A1 * 8/2010 Kalss ..... B22F 5/007 419/6
2011/0103995 A1 * 5/2011 Klekovkin ..... C22C 33/0264 419/29
2016/0047020 A1 * 2/2016 Sherof ..... C21D 6/00 148/223

FOREIGN PATENT DOCUMENTS

JP 2008223053 A 9/2008
WO WO 03/106079 A1 12/2003

OTHER PUBLICATIONS

Written Opinion (PCT/ISA/237) dated Dec. 17, 2015, by the European Patent Office as the International Searching Authority for International Application No. PCT/EP2015/071115.
Japanese Patent Office, Notice of Reasons for Refusal, dated Aug. 6, 2019, 12 Pages (including English-language translation).
Japanese Patent Office, Search Report by Registered Search Organization, dated Jul. 24, 2019, 26 Pages (including English-language translation).

* cited by examiner

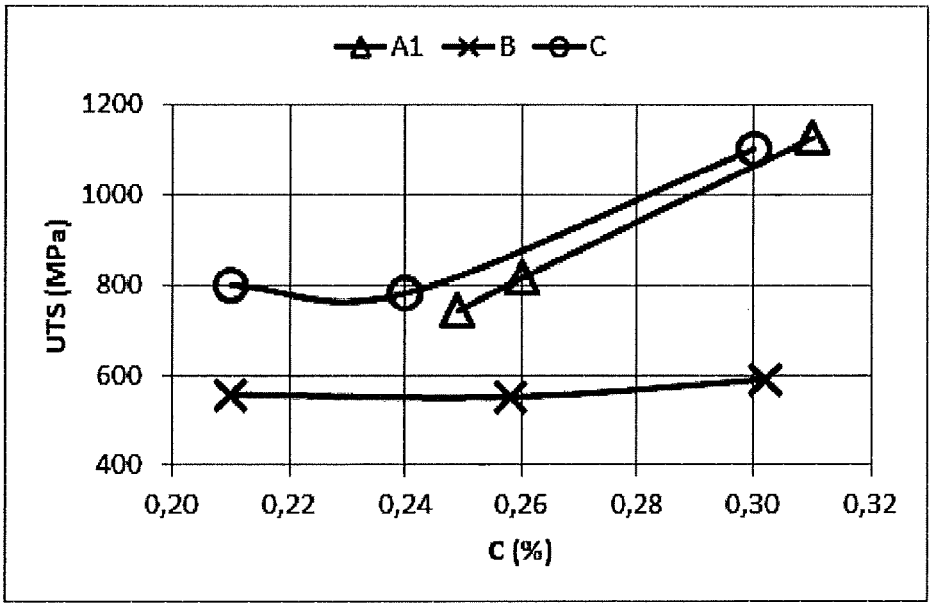
Figure 1. Ultimate tensile strength (UTS) versus carbon content for the investigated materials in Example 1.

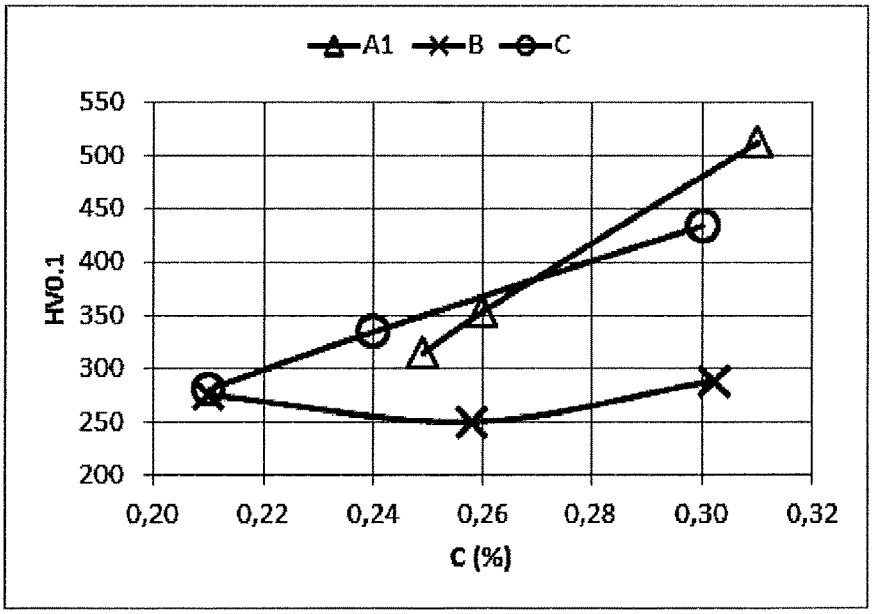
Figure 2. Microhardness (HV0.1) versus carbon content for the investigated materials in Example 1.

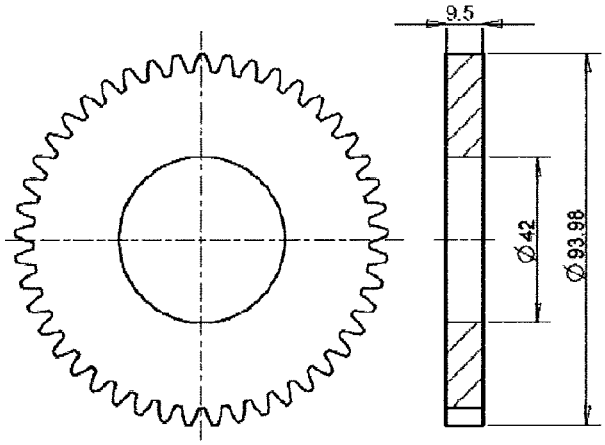
*Number of teeth: z = 45*
*Module: $m_n$ = 2.0 mm*
*Pressure angle: $\alpha$ = 20°*
Figure 3. PM gear specimen used in Example 2 (measures in mm).

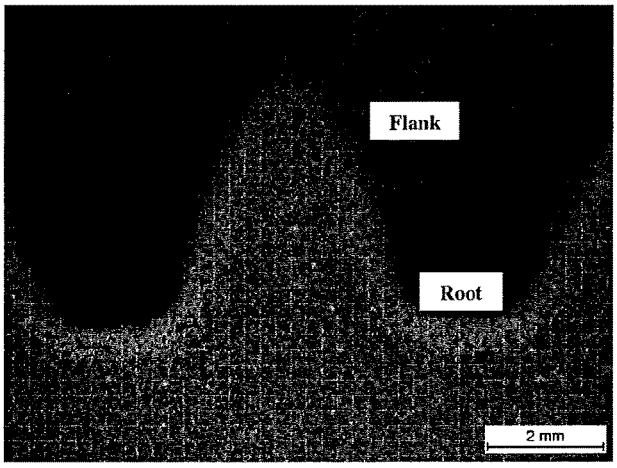
Figure 4. Metallographic image of gear tooth cross section of heat treated test sample in Example 2.

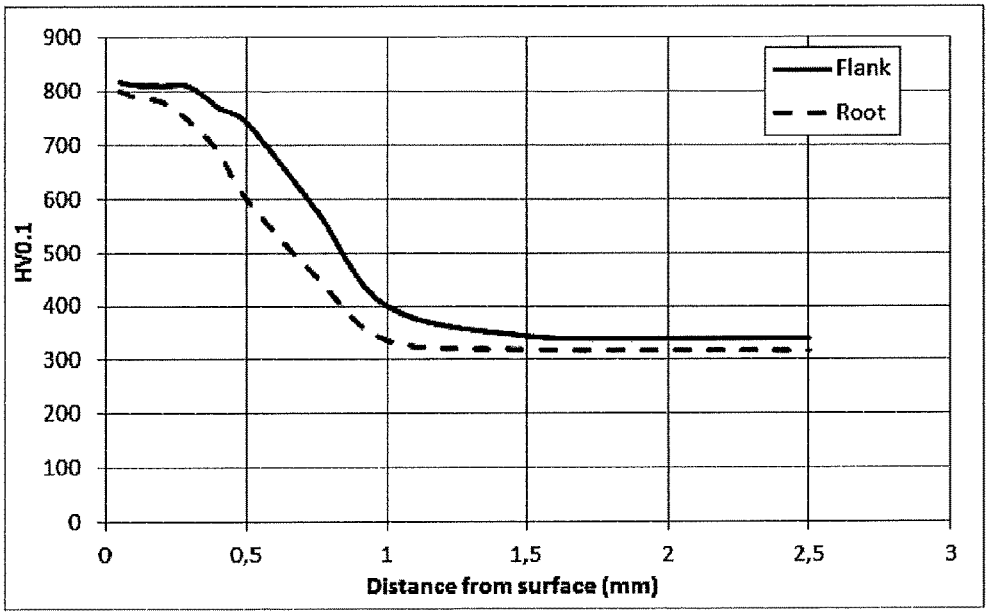
Figure 5. Microhardness (HV0.1) profiles measured on gear teeth of heat treated test sample in Example 2.

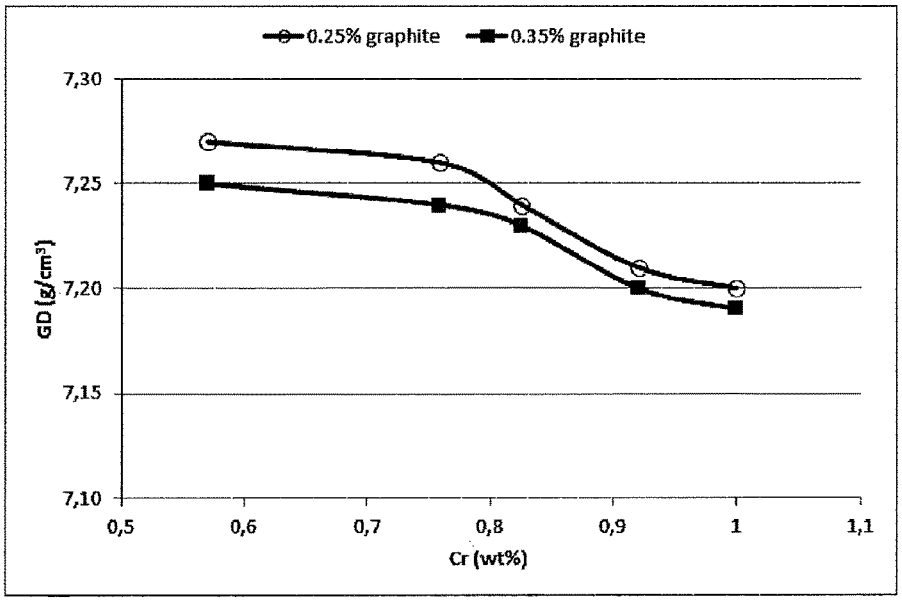
Figure 6. Green density (GD) of test specimens (after uniaxial compaction with 700 MPa compaction pressure) versus Cr-content of the pre-alloyed steel powders used in the test mixes in Example 3.

PRE-ALLOYED IRON-BASED POWDER, AN IRON-BASED POWDER MIXTURE CONTAINING THE PRE-ALLOYED IRON-BASED POWDER AND A METHOD FOR MAKING PRESSED AND SINTERED COMPONENTS FROM THE IRON-BASED POWDER MIXTURE

FIELD OF THE INVENTION

The present invention concerns a pre-alloyed iron based powder. Particularly, the invention concerns a pre-alloyed iron-based powder which includes small amounts of alloying elements, permitting cost effective manufacture of sintered parts, in particular gears.

BACKGROUND

In industry, the use of metal products manufactured by compacting and sintering metal-powder compositions is becoming increasingly widespread. A number of different products of varying shapes and thickness are being produced. The quality requirements are continuously raised and at the same time it is desired to reduce costs. The powder metallurgy (PM) technology with uniaxial pressing enables a cost effective production of components, especially when producing complex components in long series, as net shape or near net shape components can be manufactured without the need of costly machining. A drawback with the PM technology with uniaxial pressing is, however, that the sintered parts will exhibit a certain degree of porosity which may negatively influence the mechanical properties of the part. The development within the PM industry has therefore been directed to overcome the negative influence of the porosity basically along two different development directions.

One direction is to reduce the amount of pores by compacting the powder to higher green density (GD), facilitating sintering to a high sintered density (SD) and/or performing the sintering under such conditions that the green body will shrink to high SD. The negative influence of the porosity can also be eliminated by removing the pores at the surface region of the component, where the porosity is most harmful with regards to mechanical properties, through different kinds of surface densification operations.

Another development route is focused on the alloying elements added to the iron-based powder. Alloying elements may be added as admixed powders; fully pre-alloyed to the base iron powder; or bonded to the surface of the base iron powder through a so called diffusion bonding process. Carbon is normally admixed as graphite in order to avoid a detrimental increase of the hardness of the powder and decrease of compressibility if pre-alloyed. Other commonly used alloying elements are copper, nickel, molybdenum and chromium. The cost of alloying elements however, especially nickel, copper and molybdenum, makes additions of these elements less attractive. Copper will also be accumulated during recycling of scrap why such recycled material is not suitable to be used in many steel qualities where no, or a minimum of, copper is required. Chromium is more attractive due to low cost and excellent hardenability effect.

U.S. Pat. No. 4,266,974 discloses examples of alloyed powders outside the claimed scope containing only manganese and chromium as intentionally added alloying elements. The examples contains 2.92% of chromium in combination with 0.24% of manganese, 4.79% of chromium in combination with 0.21% by weight of manganese or 0.55% of chromium in combination with 0.89% by weight of manganese.

JP59173201 discloses a method for reduction annealing of a low alloyed steel powder containing chromium, manganese and molybdenum. One example shows a powder having a chromium content of 1.14% by weight and a manganese content of 1.44% by weight as the only intentionally added alloying elements.

A chromium, manganese and molybdenum based pre-alloyed steel powder is disclosed in U.S. Pat. No. 6,348,080.

WO03/106079 discloses a chromium, manganese and molybdenum alloyed steel powder having lower content of alloying elements compared with the steel powder described in U.S. Pat. No. 6,348,080. The powder is suitable to form bainitic structures at carbon content above about 0.4% by weight.

During recent years increased interest has been shown in the industry to produce components, such as gears and synchronization hubs for automotive applications, by the PM processes as such components are produced in long series and normally have a size and shape suitable for this manufacturing process. It has, however, been shown that there are difficulties to obtain sufficient strength and hardness for such components in order to withstand the harsh environment such components are subjected to. To overcome the problems, it has been necessary to apply additional process steps, such as surface densification, to obtain sufficient surface hardness and dimensional tolerances. Problems have also been encountered related to hardening of the sintered components, as the porosity in the components makes it difficult to control the case depth when conventional case hardening processes, by gas carburizing at normal pressure followed by quenching in oil, are applied. Furthermore, conventional case hardening of PM gears leads to problems with oxidation for powder materials that contain oxidation sensitive alloying elements, such as e.g. chromium. Thus, there is a need for improved materials and processes for the production of PM components aimed for stressful conditions.

SUMMARY OF THE PRESENT INVENTION

An alternative case hardening process, which enables better control of the case depth of PM parts and also minimizes oxidation issues for Cr-alloyed materials, is Low Pressure Carburizing (LPC) with subsequent High Pressure Gas Quenching (HPGQ). Furnace technology which combines high temperature vacuum-sintering with heat treatment by the LPC-HPGQ process provides excellent possibilities for cost-efficient manufacturing of high quality PM components, such as gears and synchronization hubs. This technology is also highly suitable for processing of cost-effective chromium alloyed powder steel materials. Key characteristics for such a powder material for e.g. gears and synchronization hubs are high compressibility (enabling compaction to high component density), high purity (for avoiding detrimental effects by inclusions on mechanical properties), and an optimized hardenability for the LPC-HPGQ process (giving the desired microstructure in the gear after gas quenching). The present invention consists of a new low cost lean pre-alloyed iron based powder which is designed to have all the key characteristics described above. Thus, despite low contents of alloying elements in the alloyed powder, and the relatively low cooling rate of HPGQ compared to conventional oil quenching, the hardenability of the material is sufficient to provide excellent properties of PM components, such as gears and synchronization hubs, produced by the new process. The term Low Pressure Carburizing is also meant in this context to include Low Pressure Carbonitriding.

DETAILED DESCRIPTION

In a first aspect of the present invention it is provided a pre-alloyed iron based powder consisting of;

0.7-0.9% by weight of chromium (Cr);
0.2-0.4% by weight of molybdenum (Mo);
0.01-0.15% by weight of manganese (Mn);
at most 0.20% by weight of oxygen (O);
at most 0.05% by weight of carbon (C)
less than 0.05% by weight of nitrogen (N)
at most 0.3 of other inevitable impurities; and
balance iron (Fe).

In one embodiment of the first aspect it is provided a pre-alloyed iron-based powder wherein the amount of O is at most 0.15% by weight.

In another embodiment of the first aspect it is provided a pre-alloyed iron-based powder wherein the amount of Mn is between 0.09-0.15% by weight.

In another embodiment of the first aspect it is provided a pre-alloyed iron-based powder wherein the amount of Mn is between 0.01-0.09% by weight.

In another embodiment of the first aspect it is provided a pre-alloyed iron-based powder wherein the number of inclusions having its longest extension more than 100 μm is at most 1.0/cm$^2$ as measured according to ASTM B796-02.

In another embodiment of the first aspect it is provided a pre-alloyed iron-based powder wherein the number of inclusions having its longest extension more than 150 μm is at most 0.0/cm$^2$ as measured according to ASTM B796-02.

In a second aspect of the present invention it is provided an iron-based powder mixture comprising, or containing;

a pre-alloyed iron-based powder according to the first aspect or embodiments;
graphite in an amount of 0.2-0.7% by weight of the iron based powder mixture;
optionally lubricant(s) in an amount of up to 1% by weight of the iron based powder mixture;
optionally machinability enhancing agent(s) in an amount of up to 1% by weight of the iron based powder mixture; and,
optionally hard phase materials.

In a third aspect of the present invention it is provided a method for making a sintered component comprising the steps of;

a) providing an iron-based powder mixture according to claim 8;
b) transferring the iron-based powder mixture into a compaction mold;
c) compacting the iron-based powder mixture at a compaction;

pressure of at least 600 MPa into a green compact;

d) ejecting the green compact from the mold;
e) subjecting the green compact to a sintering step;
f) Optional further densify the sintered component;
g) subjecting the sintered component to Low Pressure Carburizing; (LPC), in a carbon containing atmosphere at a pressure of at most 40 mbar, preferably at most 20 mbar;
h) subjecting the carburized component to High Pressure Gas Quenching, HPGQ, at a pressure between 10 and 30 bar and at a cooling rate of at least 5° C. from a temperature of about 850-1000° C. down to at least below about 300° C.; and
i) optionally subjecting the quenched component to tempering in air at a temperature between 150-300° C.

In one embodiment of the third aspect of the present invention it is provided a method wherein the green compact after ejection (from step d above) has a green density of at least 7.10 g/cm$^3$, preferably at least 7.15 g/cm$^3$ and most preferably at least 7.20 g/cm$^3$.

In one embodiment of the third aspect of the present invention it is provided a method wherein the sintering step comprises sintering at a temperature between 1000° C. and 1350° C., preferably between 1200° C. and 1350° C. in a reducing atmosphere or in vacuum at a pressure of maximum 20 mbar.

In one embodiment of the third aspect of the present invention it is provided a method wherein a reducing atmosphere$_{[FDM1]}$ during sintering contains hydrogen.

In one embodiment of the third aspect of the present invention step f) consists of surface densification or Hot Isostatic Pressing (HIP).

In one embodiment of the third aspect of the present invention it is provided a method wherein the Low Pressure Carburizing step comprises carburizing in an atmosphere containing at least one of $C_2H_2$, $CH_4$ and $C_3H_8$.

1. In one embodiment of the third aspect of the present invention it is provided a method wherein the Low pressure Carburizing step further includes carbonitriding in an atmosphere containing ammonia.

In a fourth aspect of the present invention it is provided a component obtained by the third aspect or embodiments.

In a fifth aspect of the present invention it is provided a sintered component consisting of;

0.7-0.9% by weight of chromium (Cr),
0.2-0.4% by weight of molybdenum (Mo),
0.01-0.15% by weight of manganese (Mn),
0.2-1.0% by weight of carbon (C)
at most 0.15% by weight of oxygen (O).
at most 1.0%, preferably below 0.5% by weight, most preferably below 0.3% by weight of inevitable impurities other than O.
balance iron (Fe)

In one embodiment of the fifth aspect of the present invention it is provided a sintered component characterized in that the component is a gear.

In one embodiment of the fifth or forth aspect of the present it is provided a sintered component characterized in that the gear teeth surface microhardness is at least 700 HV0.1 and the gear teeth core hardness is between 300-550 HV0.1.

Preparation of the Iron-Based Pre-Alloyed Steel Powder.

The steel powder may be produced by water atomization, in a protective or non-protective atmosphere. of a steel melt containing defined amounts of alloying elements. The atomized powder may be further subjected to a reduction annealing process such as described in the U.S. Pat. No. 6,027,544; hereby incorporated by reference. The particle size of the steel powder could be any size as long as it is compatible with the press and sintering or powder forging processes. In a preferred particle size distribution, 20% by weight or less of the powder is above 150 μm and at most 30% by weight or less of the powder is below 45 μm as measured according to SS-EN 24-497. In another preferred particle size distribution, 10% by weight or less of the powder is above 75 μm and at least 30% by weight or more of the powder is below 45 μm.

Contents of the Steel Powder

Chromium, Cr, serves to strengthen the matrix by solid solution hardening. Furthermore, Cr will increase the hardenability and abrasion resistance of the sintered body. A content of Cr above 0.9 wt % of the iron-based powder will however decrease the compressibility of the steel powder. Cr content below 0.7% by weight will have insufficient effect on desired properties such as hardenability and abrasive resistance. Below 0.7 wt % Cr, only insignificant increase of compressibility in obtained.

Molybdenum, Mo, will as Cr strengthen the matrix by solid solution hardening and increase the hardenability. Mo has however less negative impact on compressibility of the steel powder and has higher hardenability effect on the sintered component compared to Cr. Mo is however relatively costly. The content of Mo is for these reasons 0.2-0.4% by weight of the iron based powder.

Manganese, Mn, will as for Cr, increase the strength, hardness and hardenability of the steel powder. However, normally a low content of Mn is desirable and a content above 0.15 wt % will detrimentally increase the formation of manganese containing inclusion in the steel powder and will also have a negative effect on the compressibility due to solid solution hardening and increased ferrite hardness. If the Mn content is below 0.01 wt % the costs for obtaining such low content will be unreasonable high. For some applications, where the positive effect of Mn is dominant over the negative, a higher interval of Mn, 0.09-0.15 wt %, may be desirable. For other applications, e.g. components subjected to high load, a lower content of Mn is desirable, such as a Mn content in the interval 0.01-0.09 wt %.

Oxygen. O, is preferably at most 0.20 wt %, to prevent formation of oxides with chromium and manganese as these oxides impair strength and compressibility of the powder. For these reasons O is preferably at most 0.15 wt %.

Carbon, C, in the steel powder shall be at most 0.05% by weight, higher contents will unacceptably decrease the compressibility of the powder. For the same reason, nitrogen, N, shall be kept less than 0.05 wt %.

The total amount of inevitable impurities including 0, C and N shall be less than 1.0% by weight, preferably the total amount of inevitable impurities, besides O, C and N shall be maximum 0.3% by weight in order not to deteriorate the compressibility of the steel powder or act as formers of detrimental inclusions.

A prerequisite for components such as gears or synchronization hubs to be used in e.g. automotive applications is high reliability against failures, which, among others, is related to high and controlled fatigue strength. In order to obtain the desired properties, not only the precise and careful combination of the alloying elements Cr and Mo is important, but also low count, and controlled maximum size, of inclusions in the steel powder. The new pre-alloyed iron based powder is characterized in having a count of inclusions having its longest extension more than 100 μm is at most 1.0/cm$^2$. The count of inclusions having its longest extension more than 150 μm is at most 0.0/cm$^2$ as measured according to ASTM B796-02.

Iron-Based Powder Mixture Composition

Before compaction the iron-based steel powder is mixed with graphite and lubricants. Graphite is added in an amount between 0.2-0.7% by weight of the composition and lubricants are added in an amount between 0.05-1.0% by weight of the composition.

In certain embodiments copper and/or nickel in the form of powder may be added in an amount up to 2% by weight of each.

Graphite

In order to enhance strength and hardness of the sintered component, carbon is introduced into the matrix. Carbon is added as graphite in amount between 0.2-0.7% by weight of the composition. An amount less than 0.2% by weight will result in a too low strength, and an amount above 0.7% will result in too high hardness, insufficient elongation and worsen the machinability properties of the finished component. The exact amount of graphite, within the interval 0.2-0.7% by weight of the iron-based powder mixture, needed to obtain core hardness of 300-550 HV0.1 depends on component size and cooling rate and can be determined by a person skilled in the art.

Copper and/or Nickel

Copper, Cu, and nickel, Ni, are commonly used alloying elements in the powder metallurgical technique. Cu and Ni will enhance the strength and hardness through solid solution hardening. Cu will also facilitate the formation of sintering necks during sintering as Cu melts before the sintering temperature is reached providing so called liquid phase sintering which is far faster than sintering in solid state. In certain embodiments Cu and/or Ni may be added to the iron-based powder mixture in an amount up to 2% by weight of each.

Lubricants

Lubricants are added to the composition in order to facilitate the compaction and ejection of the compacted component. The addition of less than 0.05% by weight of the composition of lubricants will have insignificant effect and the addition of above 1% by weight of the iron-based powder mixture will result in to low density of the compacted body.

Lubricants may be chosen from the group of metal stearates, waxes, fatty acids and derivates thereof, oligomers, polymers and other organic substances having lubricating effect.

Other Substances

Other substances such as hard phase materials and machinability enhancing agents, such as MnS, $MoS_2$, $CaF_2$, different kinds of minerals etc. may be added.

Method for Producing Sintered Components

Consolidation

The iron-based powder mixture is transferred into a mold and subjected to consolidation by e.g uniaxial compaction pressure of at least 600 MPa to a green density of at least 7.10 g/cm$^3$, preferably at least 7.15 g/cm$^3$ and most preferably at least 7.20 g/cm$^3$.

Sintering

The obtained compacted green component is further subjected to sintering for a period of time of 15 minutes to 120 minutes at a temperature of 1000-1350° C., preferably 1200-1350° C., in a reducing atmosphere, such as 90% by volume of nitrogen and 10% by volume of hydrogen at atmospheric pressure, or at reduced pressure, so called vacuum sintering at e.g. maximum 20 mbar pressure. In a preferred embodiment of vacuum sintering, hydrogen or a mixture of hydrogen and nitrogen are used as a low pressure reducing atmosphere to ensure effective reduction of oxides in the component.

Optional Further Densification

After the sintering step the sintered component may be subjected to an optimal further densification such as HIP or surface densification by e.g. surface rolling.

Hardening

After sintering, the component is subjected to a case-hardening process in a low pressure atmosphere, i.e. maximum 40 mbar, preferably maximum 20 mbar, containing a carbon containing substance such as $CH_4$. $C_2H_2$ and $C_3He$ or mixtures thereof (i.e. Low Pressure Carburizing, LPC). The carbon containing substance is introduced in the furnace when the temperature has decreased from the sintering temperature to a temperature of at most about 100° C. above the austenitization temperature, i.e. a temperature of between 850-1000° C. Alternatively, if the components are cooled after sintering to a lower temperature than between 850-1000° C., the components are heated to a temperature of at most about 100° C. above the austenitization temperature before the carbon containing substance(s) is introduced in the LPC-furnace.

The total holding time at the carburization temperature is between about 15-120 min. By performing the carburization at a low and controlled temperature above the austenitization temperature, the grain growth and distortion of the component can be minimized.

The carbon containing substance(s) is introduced into the furnace during a short period, sometimes denoted as a boost cycle. The boost cycle may be repeated for a number of times. After each boost cycle follows a period which, may be denoted the diffusion cycle. When the LPC process is performed as low pressure carbonitriding, a nitrogen containing substance, preferably as ammonia, is also introduced into the furnace.

Quenching

After the carburizing step the component is quenched at high pressure in an inert gas atmosphere, High Pressure Gas Quenching, HPGQ. Examples of quenching gases are nitrogen, $N_2$ and helium, He. Quenching is performed at a pressure between 10 and 30 bar resulting in a cooling rate of at least 5° C./s from a temperature of about 850-1000° C. down to at least below about 300° C.

Tempering

For stress relieving, the component may be subjected to tempering in air at a temperature of 150-300° C. for a period of 15-120 minutes.

Properties of the Finished Component

The combination of the pre-alloyed iron based powder and the specified production process, according to the invention, enables production of e.g. gears wherein the teeth will have a hard martensitic surface layer and a softer core consisting of mainly bainite and/or pearlite. The martensitic surface layer should have a microhardness of minimum 700 HV0.1 and the core microhardness should preferably be between 300-550 HV0.1. Such gears will have favorable distribution of stresses, i.e. favorable compressive stresses in the surface layers. Furthermore, the finished PM gear component will have a closely controlled case depth of about 0.3-1.5 mm, i.e. where the hardness is 550 HV0.1.

FIGURE LEGENDS

FIG. 1 shows ultimate tensile strength (UTS) versus carbon content for the investigated materials in Example 1.

FIG. 2 shows microhardness (HV0.1) versus carbon content for the investigated materials in Example 1.

FIG. 3 shows a PM gear specimen used in Example 2 (measures in mm).

FIG. 4 shows a metallographic image of gear tooth cross section of heat treated test sample in Example 2.

FIG. 5 shows microhardness (HV0.1) profiles measured on gear teeth of heat treated test sample in Example 2.

FIG. 6 shows green density (GD), (compressibility) of test specimens (after uniaxial compaction with 700 MPa compaction pressure) versus Cr-content of the pre-alloyed steel powders used in the test mixes in Example 3.

EXAMPLES

Example 1

A pre-alloyed steel powder according to the invention, A1, was produced by water-atomization followed by a subsequent reduction annealing process. Atomization was done in protective N2 atmosphere in a small-scale (15 kg melt size) water-atomization unit. Annealing was done in a lab-scale belt furnace in H2 atmosphere at a temperature in the range of 1000-1100° C. Milling and sieving (−212 □m) of the powders was done after annealing. The chemical composition of the powder is presented in Table 1 together with the compositions of two other pre-alloyed steel powders which are commercial grades, B=Astaloy® 85Mo and C=Astaloy@CrA, available from Höganäs AB, Sweden, and used as reference materials. All three powders have standard particle size distribution for PM and are sieved with a −212 μm mesh sieve size.

TABLE 1

Chemical composition (in wt %).

| Powder | Fe (%) | Cr (%) | Mo (%) | Mn (%) | O (%) | C (%) |
|---|---|---|---|---|---|---|
| A1 | Base | 0.90 | 0.34 | 0.03 | 0.03 | <0.01 |
| B | Base | 0.03 | 0.85 | 0.09 | 0.07 | <0.01 |
| C | Base | 1.80 | 0.04 | 0.09 | 0.14 | <0.01 |

The compressibility of the steel powders was evaluated by uniaxial compaction of cylindrical test specimens (diameter 25 mm, height 20 mm) in a lubricated die with a compaction pressure of 600 MPa. The green density (GD) of each specimen was measured by weighing the specimen in air and water in accordance with Archimedes principle. The results are given in Table 2 and show that powder A1 has considerably better compressibility than powder C and comparable compressibility to powder B.

TABLE 2

Compressibility (600 MPa compaction pressure, lubricated die).

| Powder | GD (g/cm$^3$) |
|---|---|
| A1 | 7.13 |
| B | 7.15 |
| C | 7.05 |

The steel powders were mixed with 0.25-0.35 wt % graphite (Kropfühl UF4) and 0.60 wt % lubricant (Lube E, available from Höganäs AB, Sweden). Standard tensile test bars according to ISO 2740 were produced from the powder mixes by uniaxial compaction with a compaction pressure of 700 MPa. Green density of the test bars was around 7.25 g/cm$^3$.

The test bars were sintered at 1120° C. for 30 min in $N_2/H_2$ (95/5) atmosphere. Heat treatment of the sintered specimens was done at 920° C. for 60 min in vacuum (10 mbar) followed by high pressure gas quenching with 20 bar $N_2$. No carburizing was done in this heat treatment operation, since the aim of the experiment was to evaluate the hardenability of the alloys at the carbon contents given by the graphite additions to the powder mixes. Subsequent tempering was done at 200° C. for 60 min in air.

Tensile testing was done on the heat treated test specimens. The test results show that A1 and C have similar ultimate tensile strength (UTS) values of about 750-1130 MPa over the investigated carbon content range; see FIG. 1. Material B has significantly lower UTS values of below 600 MPa for all carbon contents. Microhardness measurements (HV0.1 according to the Vickers method) were also performed on polished cross sections of the heat treated test specimens; see results in FIG. 2. Material A1 has microhardness values of 310-510 HV0.1 for carbon contents in the range of 0.25-0.31% C. Material B has relatively low microhardness of below 300 HV0.1 even at the highest evaluated carbon content (0.30% C). The microhardness values of material C are relatively comparable to those of material A1.

This example demonstrates that powder A1 has an attractive combination of properties for a PM gear material. The high compressibility enables compaction to high density and the hardenability is sufficient to provide microhardness values in the range of 300-550 HV0.1. This is the desired hardness range for core hardness of gear teeth after case hardening in the manufacture of gears for highly loaded transmission applications. The evaluated carbon contents correspond to typical carbon levels in the core areas of gear teeth.

Example 2

A pre-alloyed steel powder A2, according to the invention, was produced by water-atomization followed by a subsequent reduction annealing process. Atomization was done in protective N2 atmosphere in a small-scale (15 kg melt size) water-atomization unit. Annealing was done in a lab-scale belt furnace in H2 atmosphere at a temperature in the range of 1000-1100° C. Milling and sieving (−212 □m) of the powders was done after annealing. The chemical composition of the powder is presented in Table 2. The powder has standard particle size distribution for PM and is sieved with a −212 μm mesh sieve size.

TABLE 2

| Chemical composition (in wt %). | | | | | | |
|---|---|---|---|---|---|---|
| Powder | Fe (%) | Cr (%) | Mo (%) | Mn (%) | O (%) | C (%) |
| A2 | Base | 0.85 | 0.30 | 0.04 | 0.06 | <0.01 |

Powder A2 was mixed with 0.40 wt % graphite (C-UF) and 0.60 wt % lubricant (Lube E). Large gear specimens (see dimensions in FIG. 3) were compacted from the powder mix by uniaxial compaction with a compaction pressure of 700 MPa. Green density of the gear specimens was 7.20 g/cm$^3$.

The gear specimens were sintered at 1250° C. for 30 min in $N_2/H_2$ (95/5) atmosphere. Case hardening of the sintered gears was done by low pressure carburizing (LPC) at 965° C. followed by high pressure gas quenching with 20 bar $N_2$. Base atmosphere in the LPC process was $N_2$ (8 mbar pressure) and the carburizing gas was $C_2H_2/N_2$ (50/50). Four carburizing boost cycles were applied with a length of each boost cycle of 37-65 seconds. The diffusion time after each boost cycle varied between 312-3550 seconds. The total time at 965° C. was 96 minutes. Subsequent tempering after gas quenching was done at 200° C. for 60 minutes in air.

A metallographic examination performed on polished and etched cross sections of the heat treated gear specimens shows that the gear teeth have a martensitic surface layer and a bainitic core structure; see FIG. 4. Microhardness measurements (HV0.1 according to the Vickers method) were also done on the polished cross sections to investigate the hardness profiles of the gear teeth, see results in FIG. 5. These measurements show that surface hardness is above 800 HV0.1 and that the core hardness is 320-340 HV0.1, with somewhat lower hardness levels at the root of the teeth than at the flank. The case depth (where the hardness is 550 HV0.1) is 0.8 mm at the flank and 0.6 mm at the root.

This example demonstrates that powder A2 is suitable for the manufacture of high strength PM gears in a process where case hardening is done by the LPC-HPGQ method. A graphite content of 0.40 wt % of the iron-based powder mixture was used in the powder mix in order to provide sufficient hardenability to the alloy at the cooling rates obtained inside large gear components when HPGQ is applied. The high compressibility of the powder enables compaction to high density of the gear, and desired levels of hardness values after heat treatment are obtained, both at the surface and in the core areas of the gear teeth. Well-defined cased depths were also accomplished.

Example 3

Pre-alloyed steel powders with different contents of Cr (0.5-1.0%) and the same content of Mo (0.3%) were produced by water-atomization followed by a subsequent reduction annealing process. Atomization was done in protective N2 atmosphere in a small-scale (15 kg melt size) water-atomization unit. Annealing was done in a lab-scale belt furnace in H2 atmosphere at a temperature in the range of 1000-1100° C. The same annealing parameters were used for all powders. Milling and sieving (−212□m) of the powders was done after annealing. Chemical composition of the powders is presented in Table 3.

TABLE 3

| Chemical composition (in wt %). | | | | | | |
|---|---|---|---|---|---|---|
| Powder | Fe | Cr (%) | Mo (%) | Mn (%) | O (%) | C (%) |
| X1 | Base | 0.57 | 0.30 | 0.04 | 0.11 | <0.01 |
| X2 | Base | 0.76 | 0.32 | 0.03 | 0.13 | <0.01 |
| X3 | Base | 0.83 | 0.32 | 0.04 | 0.13 | <0.01 |
| X4 | Base | 0.92 | 0.33 | 0.03 | 0.12 | <0.01 |
| X5 | Base | 1.00 | 0.32 | 0.03 | 0.11 | <0.01 |

The steel powders were mixed with 0.25/0.35 wt % graphite (Kropfmühl UF4) and 0.60 wt % lubricant (Lube E, available from Höganäs AB, Sweden). The compressibility of the powder mixes was evaluated by uniaxial compaction of cylindrical test specimens (diameter 25 mm, height 20 mm) with a compaction pressure of 700 MPa. The green density (GD) of each specimen was measured by weighing the specimen in air and water in accordance with Archimedes principle. The results are presented in FIG. 6 and demonstrates that a pre-alloyed iron based powder with an alloying content of 0.7-0.9 wt % Cr and 0.3 wt % Mo (in accordance with the claimed invention) yields high compressibility and that Cr content shall be at most 0.9 wt %. Cr-content below 0.7 wt % does not significantly increase the compressibility, i.e. yields higher green density (GD).

The invention claimed is:

1. A method for making a sintered and carburized component comprising the steps of:

a) providing an iron-based powder mixture comprising:

a1) a pre-alloyed iron-based powder consisting of:

a1i) 0.7-0.9% by weight of chromium (Cr);
a1ii) 0.2-0.4% by weight of molybdenum (Mo);
a1iii) 0.01-0.15% by weight of manganese (Mn);
a1iv) at most 0.20% by weight of oxygen (O);
a1v) at most 0.05% by weight of carbon (C)
a1vi) less than 0.05% by weight of nitrogen (N)
a1vii) at most 0.3 of other inevitable impurities; and
a1viii) balance iron (Fe);

a2) graphite in an amount of 0.2-0.7% by weight of the iron based powder mixture;

a3) optionally lubricant(s) in an amount of up to 1% by weight of the iron based powder mixture;

a4) optionally machinability enhancing agent(s) in an amount of up to 1% by weight of the iron based powder mixture; and a5) optionally hard phase materials;

b) transferring the iron-based powder mixture into a compaction mold;

c) compacting the iron-based powder mixture at a compaction; pressure of at least 600 MPa into a green compact;

d) ejecting the green compact from the mold;

e) subjecting the green compact to a sintering step;

f) optionally, further densifying the sintered component;

g) subjecting the sintered component to Low Pressure Carburizing (LPC), in a carbon containing atmosphere at a pressure of at most 40 mbar;

h) subjecting the carburized component to High Pressure Gas Quenching (HPGQ), at a pressure between 10 and 30 bar and at a cooling rate of at least 5° C. from a temperature of about 850-1000° C. down to at least below about 300° C.; and i) optionally subjecting the quenched component to tempering in air at a temperature between 150-300° C., wherein the Low Pressure Carburizing step comprises carburizing in an atmosphere containing at least one of $C_2H_2$, $CH_4$ and $C_3H_8$.

2. The method according to claim 1, wherein the amount of Mn is 0.09-0.15% by weight.

3. The method according to claim 1, wherein the amount of Mn is 0.01-0.09% by weight.

4. The method according to claim 1, wherein the amount of O is less than 0.15% by weight.

5. The method according to claim 1, wherein the amount of inevitable impurities beside O, C and N is at most less than 0.3% by weight.

6. The method according to claim 1, wherein the number of inclusions having its longest extension longer than 100 μm is at most 1.0/cm$^2$ as measured according to ASTM B796-02.

7. The method according to claim 1, wherein the number of inclusions having its longest extension longer than 150 μm is at most 0.0/cm$^2$ as measured according to ASTM B796-02.

8. The method according to claim 1 wherein the green compact after ejection has a green density of at least 7.10 g/cm$^3$.

9. The method according to claim 1 wherein the sintering step comprising sintering at a temperature between 1000° C. and 1350° C., in a reducing atmosphere or in vacuum at a pressure less than 20 mbar.

10. A method according to claim 9 for making a sintered and carburized component comprising the steps of:

a) providing an iron-based powder mixture comprising:

a1) a pre-alloyed iron-based powder consisting of:
a1i) 0.7-0.9% by weight of chromium (Cr);
a1ii) 0.2-0.4% by weight of molybdenum (Mo);
a1iii) 0.01-0.15% by weight of manganese (Mn);
a1iv) at most 0.20% by weight of oxygen (O);
a1v) at most 0.05% by weight of carbon (C)
a1vi) less than 0.05% by weight of nitrogen (N)
a1vii) at most 0.3 of other inevitable impurities; and
a1viii) balance iron (Fe);

a2) graphite in an amount of 0.2-0.7% by weight of the iron based powder mixture;

a3) optionally lubricant(s) in an amount of up to 1% by weight of the iron based powder mixture;

a4) optionally machinability enhancing agent(s) in an amount of up to 1% by weight of the iron based powder mixture; and a5) optionally hard phase materials;

b) transferring the iron-based powder mixture into a compaction mold;

c) compacting the iron-based powder mixture at a compaction; pressure of at least 600 MPa into a green compact;

d) ejecting the green compact from the mold;

e) subjecting the green compact to a sintering step;

f) optionally, further densifying the sintered component;

g) subjecting the sintered component to Low Pressure Carburizing (LPC), in a carbon containing atmosphere at a pressure of at most 40 mbar;

h) subjecting the carburized component to High Pressure Gas Quenching (HPGQ), at a pressure between 10 and 30 bar and at a cooling rate of at least 5° C. from a temperature of about 850-1000° C. down to at least below about 300° C.; and i) optionally subjecting the quenched component to tempering in air at a temperature between 150-300° C., wherein the Low Pressure Carburizing step further includes carbonitriding in an atmosphere containing ammonia.

11. The method according to claim 10, wherein the amount of Mn is 0.09-0.15% by weight.

12. The method according to claim 10, wherein the amount of Mn is 0.01-0.09% by weight.

13. The method according to claim 10, wherein the amount of 0 is less than 0.15% by weight.

14. The method according to claim 10, wherein the amount of inevitable impurities beside O, C and N is at most less than 0.3% by weight.

15. The method according to claim 10, wherein the number of inclusions having its longest extension longer than 100 μm is at most 1.0/cm$^2$ as measured according to ASTM B796-02.

16. The method according to claim 10, wherein the number of inclusions having its longest extension longer than 150 μm is at most 0.0/cm$^2$ as measured according to ASTM B796-02.

17. The method according to claim 10, wherein the green compact after ejection has a green density of at least 7.10 g/cm$^3$.

18. The method according to claim 10, wherein the sintering step comprising sintering at a temperature between 1000° C. and 1350° C., in a reducing atmosphere or in vacuum at a pressure less than 20 mbar.

19. A sintered component consisting of:
0.7-0.9% by weight of chromium (Cr);
0.2-0.4% by weight of molybdenum (Mo);
0.01-0.15% by weight of manganese (Mn);
0.2-1.0% by weight of carbon (C);
at most 0.15% by weight of oxygen (O);
at most 1.0% of inevitable impurities; and
balance iron (Fe), wherein the component is a gear wherein gear teeth surface microhardness is minimum 700 HV0.1 and the gear teeth core hardness is between 300-550 HV0.1.

* * * * *